US010946231B2

(12) United States Patent
D'Alesio

(10) Patent No.: US 10,946,231 B2
(45) Date of Patent: Mar. 16, 2021

(54) EXERCISE DEVICE

(71) Applicant: REAXING S.R.L., Milan (IT)

(72) Inventor: Gionata D'Alesio, Ascoli Piceno (IT)

(73) Assignee: REAXING S.R.L., Milan (IT)

( * ) Notice: Subject to any disclaimer, the term of this patent is extended or adjusted under 35 U.S.C. 154(b) by 39 days.

(21) Appl. No.: 16/091,575

(22) PCT Filed: Apr. 5, 2017

(86) PCT No.: PCT/IB2017/051953
§ 371 (c)(1),
(2) Date: Oct. 5, 2018

(87) PCT Pub. No.: WO2017/175150
PCT Pub. Date: Oct. 12, 2017

(65) Prior Publication Data

US 2019/0151700 A1 May 23, 2019

(30) Foreign Application Priority Data

Apr. 6, 2016 (IS) ..... UA2016A002185
Nov. 15, 2016 (IT) ..... UA2016A008258

(51) Int. Cl.

| | |
|---|---|
| ***A63B 21/055*** | (2006.01) |
| ***A63B 21/00*** | (2006.01) |
| ***A63B 21/08*** | (2006.01) |
| ***A63B 21/04*** | (2006.01) |
| ***A63B 21/06*** | (2006.01) |
| ***A63B 21/075*** | (2006.01) |
| ***A63B 21/072*** | (2006.01) |

(52) U.S. Cl.
CPC ..... *A63B 21/0557* (2013.01); *A63B 21/0004* (2013.01); *A63B 21/00072* (2013.01);
(Continued)

(58) Field of Classification Search
CPC ..... A63B 21/00043; A63B 21/02; A63B 21/055–0557; A63B 21/0608–0609;
(Continued)

(56) References Cited

U.S. PATENT DOCUMENTS 1,528,909 A * 3/1925 Bullard ..... A63B 69/0079 473/146
2,307,905 A * 1/1943 Ament ..... A01K 15/025 119/708

(Continued)

FOREIGN PATENT DOCUMENTS

| | | |
|---|---|---|
| DE | 20 2014 005 201 U1 | 2/2015 |
| EP | 1 066 859 A2 | 1/2001 |
| WO | 2008/072054 A1 | 6/2008 |

OTHER PUBLICATIONS

International Search Report and Written Opinion, dated Jul. 10, 2017, from corresponding PCT application No. PCT/IB2017/051953.

*Primary Examiner* — Jennifer Robertson
(74) *Attorney, Agent, or Firm* — Nixon & Vanderhye

(57) ABSTRACT

Disclosed is an exercise device including flexible suspension unit, a mass, a fastening element and optionally a separate grip, wherein: a) the flexible suspension unit, elongated and thin in shape, are connectable at the level of at least a first end to the fastening element and at the level of an opposite end to one of such components; b) the mass has a through hole through which the suspension unit passes, the through hole being provided with a first opening and a second opening; and c) the fastening element can be blocked on the body of the mass.

9 Claims, 9 Drawing Sheets

(52) U.S. Cl.
CPC ..... *A63B 21/0442* (2013.01); *A63B 21/06* (2013.01); *A63B 21/0608* (2013.01); *A63B 21/075* (2013.01); *A63B 21/0728* (2013.01); *A63B 21/08* (2013.01); *A63B 21/4035* (2015.10); *A63B 21/00061* (2013.01)

(58) Field of Classification Search
CPC ..... A63B 21/072–075; A63B 67/10; A63B 67/20–22; A63B 69/0079–0088
See application file for complete search history.

(56) References Cited

U.S. PATENT DOCUMENTS 2,942,883 A * 6/1960 Moore ..... A63B 43/007 473/424
3,531,115 A * 9/1970 Alexander ..... A63B 69/0088 473/424
5,693,900 A 12/1997 Calato et al.
5,853,339 A * 12/1998 Scerbo ..... A63B 69/0086 473/576
6,514,161 B1 * 2/2003 Minniear ..... A63B 69/0002 473/423
6,692,415 B1 * 2/2004 Winston ..... A63B 21/0004 482/122
8,540,584 B1 9/2013 Sorenson
8,574,102 B1 * 11/2013 Russell ..... A63B 43/007 473/425
8,904,605 B2 * 12/2014 Kawaguchi ..... F16G 11/101 24/115 G
2008/0242451 A1 * 10/2008 Chandless ..... A63B 69/0079 473/423
2012/0190512 A1 7/2012 Chen
2014/0287884 A1 9/2014 Buchanan
2016/0067543 A1 * 3/2016 Marvan ..... A63B 21/0552 482/121

* cited by examiner

EXERCISE DEVICE

The present invention relates to an exercise device. More in particular, it relates to a sporting device to be gripped at one end thereof to allow physical exercises to be performed with equipment in non-static position, mainly involving the arm muscles.

The invention falls within the sector of sporting equipment suitable to stimulate the reaction of the human body to so-called motor interferences, i.e. external stimuli that, during the performance of a movement, can generate a variation of the balance of the person performing the movement.

Usually, training of the muscles of the body involves the performance of free body exercises or exercises with equipment (movable devices or stationary machines). While performing these exercises, a device is handled with a fixed configuration for the whole of the exercise.

A person training with these devices voluntarily contracts his/her muscles to carry out a given movement typical of the exercise being performed.

In practice, during the performance of an exercise, any variation of position or speed of a part of the body, just as the force exerted by given muscles, is known or in any case predictable by the person performing the exercise.

However, both in the practice of some sporting activities and in normal daily actions, our body is often subjected to external stimuli, predictable or unpredictable, that can interfere with a movement that is being carried out or with a condition of stable balance. These interferences can be generated, for example, by a strong gust of wind or a sudden and unexpected movement of the axis of the body or of the object to be grasped, for example following a variation of fluctuation direction in the air.

In general, the greater the rapidity and unpredictability of the interference that occurs, the more difficulty the body has in reacting correctly to re-establish the desired condition of movement, and optionally of unperturbed balance.

In this regard, studies by Shumway-Cook A. and collaborators, Nasher L. M. and collaborators, and Mollroy and collaborators show that this capacity of our body to react can be developed and increased with a training method in which during the performance of physical exercises motor interferences are suitably imparted to the person carrying them out.

Today this capacity is developed by means of proprioceptive equipment.

Therefore, as a function of his/her proprioceptive ability, a person may be more or less able to predict, and if need be remedy, said variation of fluctuation direction in the air of a moving object, and possibly prevent said loss of balance.

The main object set and achieved with the present invention is to provide an instrument that allows a person to perform a physical exercise perturbed by motor interferences that are unexpected and that change in an unknown manner.

In particular, an object of the invention is to provide an instrument capable of generating motor interferences that cannot be controlled, or can only partially be controlled, by the person during the performance of the exercise.

The purpose of this device is, therefore, that of reproducing motor interferences to which a person in daily life, or an athlete during the performance of a sporting activity, could be subjected.

A further object of the present invention is to propose an exercise device that is inexpensive and simple to produce.

Another object of the present invention is to produce a versatile exercise device that can be used for professional or amateur training, for various sporting disciplines or for rehabilitation.

Yet another object of the present invention is to provide a practical exercise device that can also be used by beginners or inexperienced users.

The aforesaid objects are achieved with a sporting device, provided with at least two components, movable during the performance of a physical exercise, subject to a movement that can be unpredictable and, therefore, requires quick reflexes to prevent destabilization of the balance of the person carrying out this exercise, if the component has a non-negligible weight.

The present invention thus regards an exercise device comprising at least the following components: suspension means, a mass, a fastening element and optionally a separate grip, wherein:

a) the flexible suspension means, elongated and thin in shape, are connectable at the level of at least a first end thereof to said fastening element and at the level of their opposite end to one of the aforesaid components;
b) the mass has a through hole through which said suspension means pass at least in part, said through hole being provided with a first opening and a second opening; and
c) the fastening element can be blocked on the body of the mass.

More in particular, according to the present invention, as the mass is inserted onto the end portion of at least a first end of said suspension means and said first end is connectable to said fastening element, the fastening element allows the suspension means and the mass to be maintained joined to each other.

Said mass takes the shape of a solid body, which is generally spherical or spheroid in shape, such as a medicine ball, or in the shape of a disc or cylinder. Naturally, this body can also have other shapes. Moreover, the mass can have different weight values. This mass having any weight will be selected by the person performing the exercise.

Typically, but not necessarily, said through hole passes through the center of the body. Typically, this through hole ends leading into mutually opposite parts of the body. Each end forms an opening. In the context of the present invention, for convenience the openings are defined as first opening and second opening.

These first and second openings allow the suspension means and, optionally, the fastening element to exit from and, if necessary, be inserted into, the through hole.

According to an embodiment of the present invention, the suspension means are connected to a grip, where there is a separate component having this function.

According to a variant of embodiment of the present invention, said separate component is absent. In this variant, a portion of the suspension means itself acts as a grip. This portion can be said opposite end, i.e. the second end of the suspension means, or another portion of these suspension means.

Moreover, in this variant, said portion of the suspension means is preferably delimited from the rest of the suspension means by a slider. This slider can be moved along the suspension means so as to be able to vary the dimensions of the grip as desired. Typically, this slider comprises two through holes, through each of which the suspension means pass. The slider is a component well known to a person skilled in the art and therefore will not be described in more detail.

As described previously, and regardless of embodiment, the suspension means are elongated and thin in shape. Therefore, they can, for example, be a wire, a cord, a tape, or the like. Preferably these means also have elastic properties. These flexible and elastic suspension means can, for example, also be in the form of a metal spring or of a wire, a cord, of a tape or the like made of elastic material. The suspension means can also comprise a band of filiform elastic elements enclosed by a sheath or the like.

According to the invention, the device can be equipped with flexible and elastic means having different elastic constants, thus obtaining different effects of interference on the person using the device.

These suspension means can consist of a single element, such as the aforesaid wire, tape, cord, or band, or of two or more elements substantially mutually parallel.

Depending on the embodiment, the single elements mutually parallel are, typically, all connected to the separate grip close to or at the level of their second end. In the variant without separate grip, said first and said second ends can both be connected to the mass, through the fastening element, to form the grip.

The suspension means are well known to the person skilled in the art and therefore will only be described briefly below.

Such flexible suspension means allow the generation of motor interferences with different orientations in space.

The suspension means can be connected to the fastening element in any way, for example by tying the suspension means to the fastening element.

According to an embodiment of the present invention, the suspension means have at the level of or close to at least one end, a blocking element adapted to constrain the suspension means to the fastening element.

As mentioned above, according to an embodiment of the present invention, the suspension means are connected to a separate component that acts as grip.

The blocking element can be produced in various ways, for example a slot into which to insert the fastening element.

According to a preferred embodiment of the present invention, the blocking element takes the form of any means adapted to allow the suspension means to be maintained inserted in said fastening element. Therefore, any enlargement, such as a knot or a sphere, present at, or close to, said end of the suspension means can be adapted to act as blocking element.

The fastening element is adapted to keep the suspension means constrained to the mass.

As described previously, a part of said suspension means is housed in the through hole. Preferably, according to the invention at least a first end of the suspension means can be connected in any point of the fastening element between the first opening and the second opening of said through hole.

According to another aspect of the invention, at least a part of the fastening element remains outside said through hole and abuts against the area surrounding said second opening of the body of the mass. Therefore, this element has a shape with at least one width or length dimension greater than the larger dimension of said lower opening. Typically the element has an annular shape.

According to an embodiment, the fastening element is composed of:

- a first piece, hereinafter defined hollow piece, which can be inserted into said through hole and provided internally with a cavity, and optionally
- a second piece, hereinafter defined abutment element, which abuts against the area surrounding at least one opening of the body of the mass.

If the second piece is present, the two first and second pieces are preferably mutually perpendicular.

Depending on of the embodiment, said cavity may or may not be a through cavity.

According to an alternative embodiment, the hollow piece can be without the abutment element. If necessary, said abutment element can be replaced by another element equivalent in function, i.e. adapted to maintain the fastening element inside the through hole.

Typically, the hollow piece is provided with the abutment element at least at one of its ends.

According to this embodiment, said hollow piece is also adapted to house at least one portion of that part or those parts of the suspension means inserted in the through hole of the mass.

The through cavity has width dimensions proportional to the suspension means to be housed therein. In fact, as described previously, the number of elements of which these latter is composed, just as their diameter, thickness and width dimensions, can vary.

According to an embodiment of the present invention, the through cavity has a structure of the type with a single cavity.

At the level of the blocking element and, typically up to the second opening present on the body of the mass, the seat has a sufficiently large cross section to be able to house this element. Differently, in the remaining portion, the seat has a smaller cross section than the cross section of the blocking element to prevent it from sliding in this portion. To block the suspension means in various points of the hollow piece, several seats can be provided between the first opening and the second opening, so as to vary the length of the portion of said suspension means that project beyond the mass.

According to another variant, the cavity is divided into two or more seats mutually separated by a partition. The partition typically has a shorter length than the through cavity.

This structure allows suspension means composed of at least two elements to be housed. Each seat houses at least one element of the suspension means.

According to a variant, the suspension means have the blocking element, whose dimensions are sufficiently large to prevent said element from sliding along the whole through cavity of said hollow piece of the fastening element, so that the suspension means remain fastened to the fastening element.

The suspension means are prevented from sliding in the through cavity by varying the width, i.e. the dimension of the cross section, of the through cavity. Preferably, this variation in width is provided in the portion closest to or at the level of the abutment element, or both, and therefore of the second opening of the mass. This variation, in particular a narrowing, can be encountered, for example, only in an appropriate segment, as explained below, of the through cavity or can be found in a large part of the length of said through cavity.

In the first embodiment, for example, a protrusion or a step of the inner surface of the through cavity, projecting toward the inside of the through cavity, produces a narrowing of this cavity.

More in detail, in the second embodiment, the through cavity has a dimension of the cross section that is greater both with respect to the dimension of the cross section of the remaining cavity and with respect to the blocking element.

This structure of the through cavity allows the blocking element to be housed in this wider portion of the through cavity of the hollow piece of the fastening element.

According to an aspect of the invention, the cavity can have at least two different portions, one having a greater dimension of the cross section with respect to the other, said portion of greater section being closer to, or at the level of, the opening of the through hole or of the abutment element, if provided.

According to a variant of the invention, the fastening element has a slot that cuts this element between one end and the other in the direction of its length. This slot has a depth equal to the thickness of the wall of the through cavity. Thanks to this slot, the end portion of the suspension means can be inserted into the through cavity of the fastening element.

According to another possible variant of the invention, the suspension means comprise a single bent element having the second end thereof fastened in the cavity of the fastening element.

In a particular embodiment, the cavity of the fastening element has at least two seats, each housing one end of the suspension means, In this variant the suspension means are typically bent in a U-shape. The two seats are separated by a partition that extends along a direction substantially parallel to the major axis of the fastening element.

Preferably, this partition creates at least one narrowing in the at least two seats to prevent sliding of the blocking element of the suspension means. According to a possible embodiment of the present invention, the fastening element, or at least the hollow piece, is composed of at least two separable parts. According to this particular embodiment, the fastening element can be separable along a plane parallel to the major axis of the hollow piece.

Preferably, as each part is one half of the fastening element, or of the hollow piece, this latter is separable along the centerline plane into two parts substantially mutually symmetrical. Thanks to this opening, insertion and removal of the suspension means in the fastening element are facilitated.

Each of the separable parts of the fastening element, or of the hollow piece, can also comprise closing means, for example screws, interlocking profiles or equivalent means. However, joining of the two separable parts can also be guaranteed only by the through hole of the mass, when the fastening element is housed therein.

According to another embodiment of the present invention, the fastening element comprises two parts separable along the major axis of the hollow piece. Each end of the suspension means is connected to one of the parts of the fastening element.

More in detail, at one end each part has an inlet for the passage of a portion of the suspension means. This inlet is typically facing the outside when the two parts of the fastening element are inserted in the through hole.

Said two parts of the fastening element can therefore be inserted in the through hole of the mass respectively through opposite openings. For this purpose, at an end opposite the inlet end, the two parts have connection means that allow the aforesaid two parts to be maintained joined when they are inserted into the through hole.

According to a preferred variant, said connection means comprise magnets arranged at said end opposite the inlet end. When the two parts are housed in the through hole, the opposite ends of each part are in mutual contact or in any case moved close to each other, so that the magnetic force of the magnets maintains them attracted to each other.

A covering sheath can surround the suspension means for all or at least a part of their length, typically at least the part that is not inserted into the through hole of the mass.

The separate grip, if present, can take various shapes and dimensions and is preferably of ergonomic type.

Both the grip and any constraint between it and the suspension means can be made in a known manner within the reach of a person skilled in the art, for example by means of an coupling of appropriate size or structure, and therefore will not be described in further detail hereinafter in the description.

Further features and details of the invention will be better understood from the description below, provided by way of non-limiting example, and from the accompanying drawings, wherein.

Figure 1:
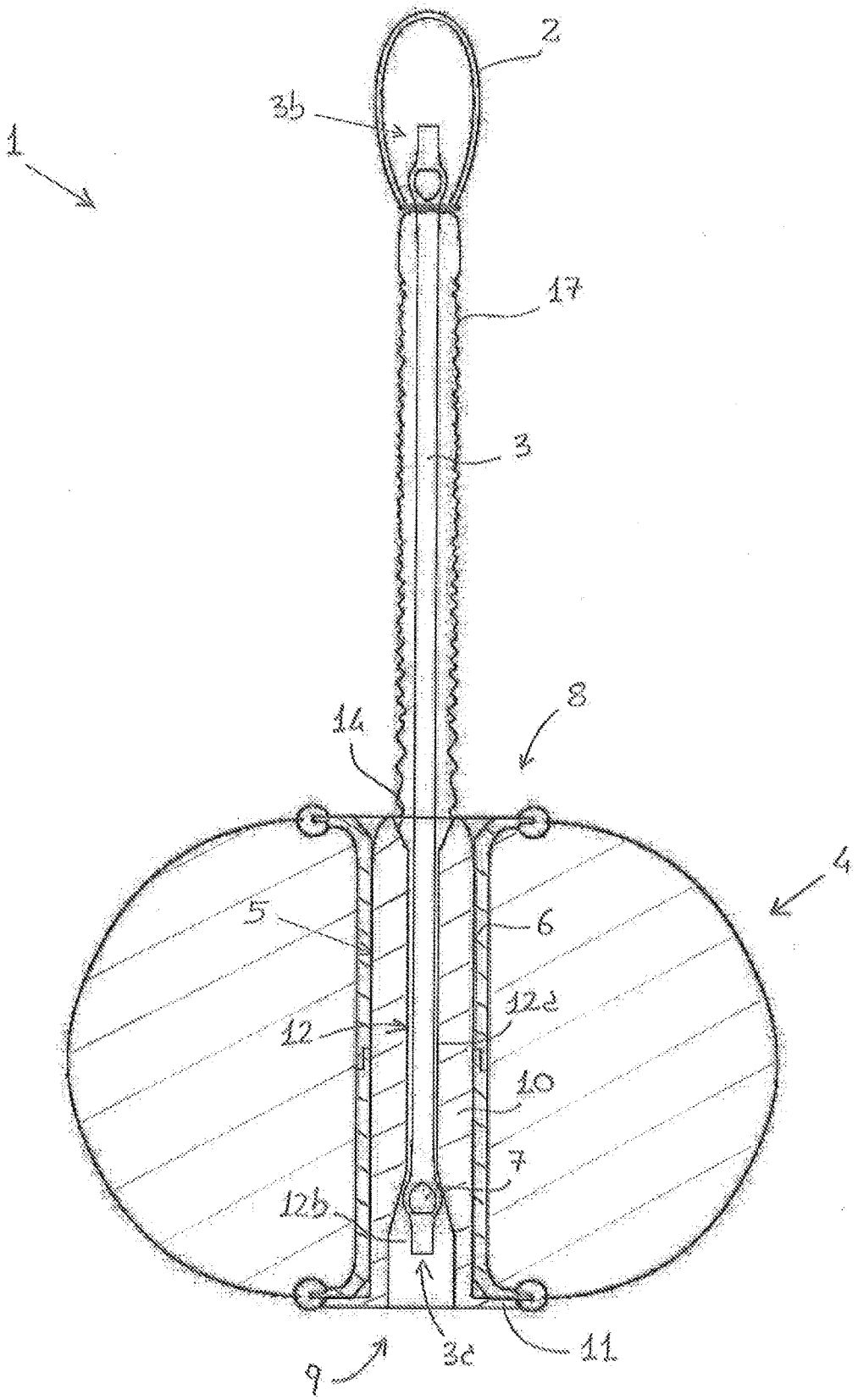
FIG. 1 is a representation of a sectional front view of the device according to an embodiment of the present invention.

With reference to FIG. 1, the reference numeral 1 indicates the exercise device as a whole according to a preferred embodiment of the present invention.

In conformity with the invention and as illustrated in FIG. 1, the exercise device comprises a grip 2, suspension means 3, a mass 4 and a fastening element 5. The fastening element 5 comprises a hollow piece 10 and an abutment element 11.

The suspension means 3 have a blocking element 7 at the level of, or at, a first end 3*a* thereof.

Figure 2:
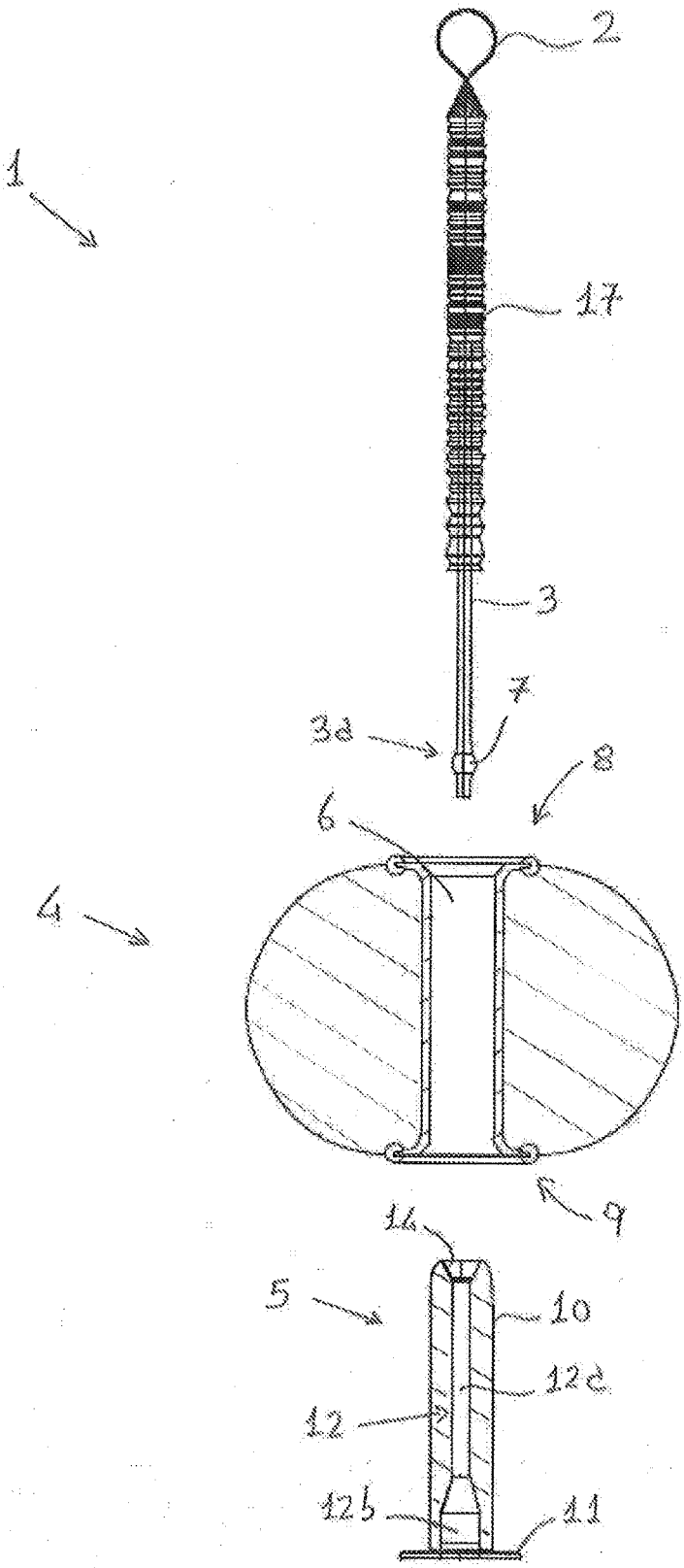
FIG. 2 is a representation of an exploded view of the device according to the embodiment illustrated in FIG. 1.

The suspension means 3 or at least their first end 3*a*, or the portion close to this end, can be hollow or solid. Depending on whether the suspension means 3 are hollow or solid inside, this blocking element 7 can be on the inside (as illustrated in FIG. 2) or on the outside (not illustrated in the figure) of the suspension means. The element 7 is, for example, a ball or the like.

This blocking element 7 cooperates with the fastening element 5 to connect the mass 5 to the suspension means 3.

The mass 4 has a body with a through hole 6 that, typically, passes through the center of the body. The hole 6 has two openings, defined first opening 8 and second opening 9. The body can take a spheroid shape flattened at the two poles.

The fastening element 5 also consists of a hollow piece 10 that, at the level of one of its two ends, ends with an abutment element 11.

In another variant of the invention, not illustrated in the figures, the fastening element comprises only the hollow piece 10 and is blocked in the body of the mass by means of an abutment obtained at the first opening 8 of the through hole 6.

As can be seen in FIGS. 1 and 2, the hollow piece 10 has smaller width dimensions than the through hole 6, so that it can be inserted into this hole 6. Moreover, its length is less than or, preferably, approximately equal to, the length of the hole 6. Typically, the hollow piece 10 has a cylindrical shape.

Moreover, the hollow piece 10 has a through cavity 12 for the purpose of housing a part of said suspension means 3. The through cavity 12 ends leading, on one side, into the first opening 8 and, on the opposite side, into the second opening 9.

The major axis of the through cavity 12 coincides with the major axis of this hollow piece 10. Typically, the cavity 12 has a cross section, i.e. with respect to a plane substantially perpendicular to the major axis 12, of circular shape.

In particular, the portion of the cavity 12 with major diameter is the portion closest to the abutment element 11. Therefore, the end portion 12*b* has a diameter with a section of larger dimension with respect to the dimension of the section of the portion 12*a*.

Moreover, the diameter of the section of the portion 12*a* has a smaller dimension than the diameter or width of the blocking element, while the diameter of the section of the portion 12*b* has a larger dimension than the diameter or width of the blocking element 7. This difference in dimension of the diameter of the cavity 12 allows the blocking element 7 to be inserted into and to slide only in the end portion 12*b*, but not in the portion 12*a* of the cavity 12. Therefore, this measure allows the suspension means to be fastened in the hollow piece of the fastening element.

Figure 4:
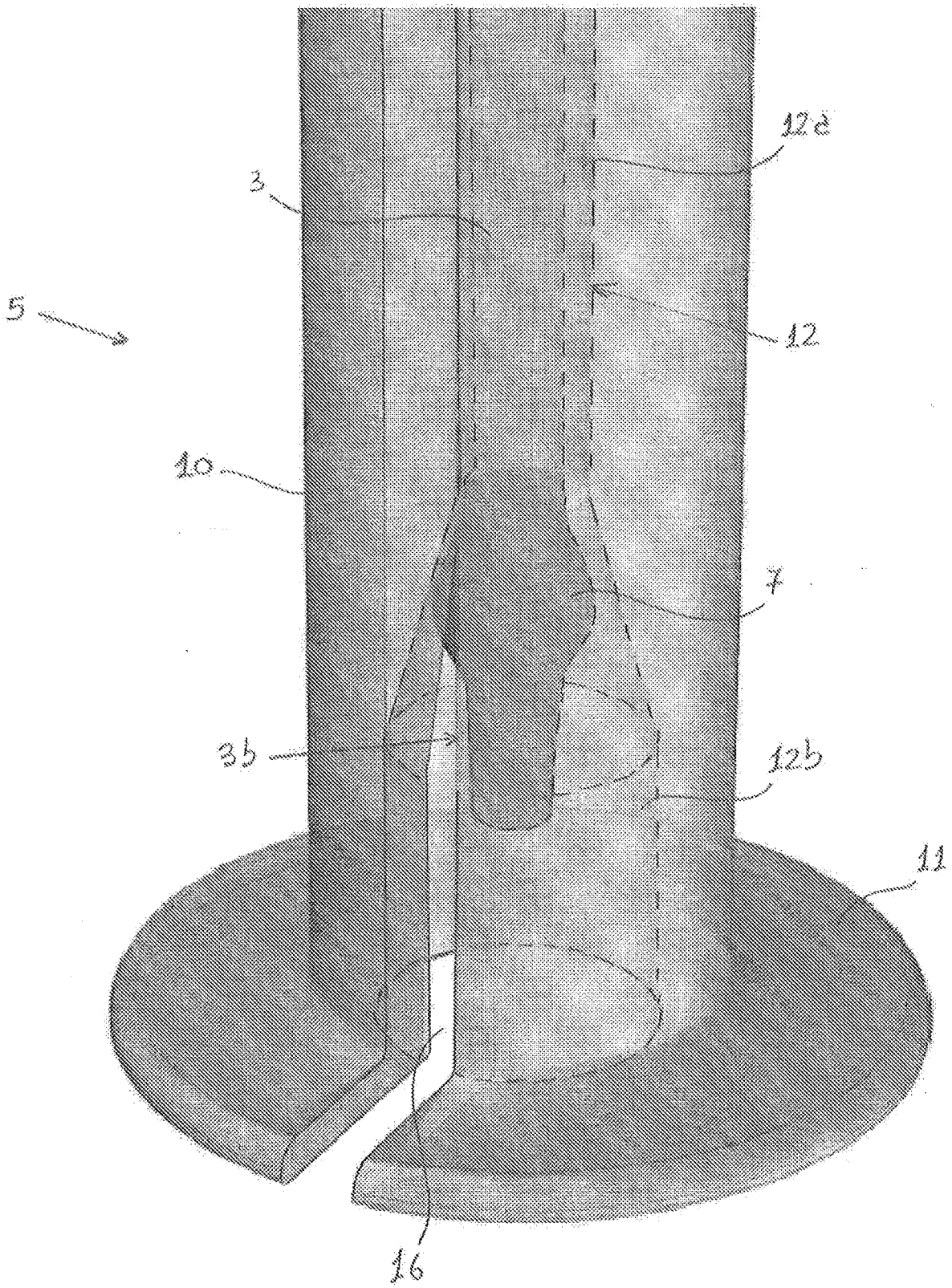
FIG. 4 is a representation of a detail of the device according to the embodiment of the present invention illustrated in FIG. 1.

As can be seen in FIG. 4, the abutment element 11 typically has the shape of a circular ring.

As can be seen in FIG. 1, said abutment element 11 rests against the area surrounding the second opening 9 of the body of the mass 4. Therefore, this element prevents the fastening element 5 from sliding completely in the hole 6 of the body of the mass 4.

According to a particularly preferred embodiment, this fastening element 5 has a slot 16 along the whole of said element, as can be seen in FIG. 4. More precisely, this slot 16 runs continuously both along the hollow piece 10 for the whole of its length and along the ring of the abutment element 11 for the whole of its width.

As can be seen in FIG. 4, this slot 16 has a depth that extends from the lateral surface of the fastening element 5 to its cavity 12. Consequently, the depth of the slot 16 is equal to the thickness of the abutment element 11, while in the hollow piece 10 it is equal to the thickness of the wall of the cavity 12.

Preferably, the slot 16 has a rectilinear course.

The slot 16 allows part of the suspension means 3 and, if present, the blocking element 7 to be inserted into the cavity 12 of the fastening element 5.

According to a preferred embodiment of the present invention, close to and at the level of the first opening 8 of the body, this cavity 12 is wider with respect to the cavity below and, typically, takes the shape of a countersink 14. This countersink 14 allows a greater angle to be achieved between the suspension means 3 and the mass 4 during specific movements, such as rotation, of the mass carried out during use of the exercise device according to the present invention.

According to another variant of the invention, the suspension means 3 consists of a single element bent in a U-shape and having its second end 3*b* fastened in the through cavity 12 of the fastening element 5.

In this variant, the grip 2 consists mainly of the curved portion 2*a* of this bent element and is preferably delimited by a slider 18 comprising two through holes, through each of which each arm 3*c*, 3*d* of the element bent in a U-shape passes. The slider 18 is preferably movable along the two arms 3*c*, 3*d*, so that its position along said arms can be adjusted.

According to an embodiment of this variant, not illustrated in the figures, the cavity 12 has a single seat in which the end part of the two arms 3*c*, 3*d* of the U shape formed by the suspension means 3 is housed. Close to the end 3*a*, 3*b*, each of the arms is provided with the blocking element 7, for example is hollow inside, so as to allow a ball 7 to be housed in each said arm. The cavity 12 has a protrusion that projects toward the inside of the cavity 12. This protrusion acts in cooperation with said blocking elements 7 so as to prevent the suspension means from sliding in the cavity 12 toward the first opening 8 of the mass 4. This protrusion can be localized in any area of the cavity 12, close to or distanced from the abutment element 11.

Figure 5:
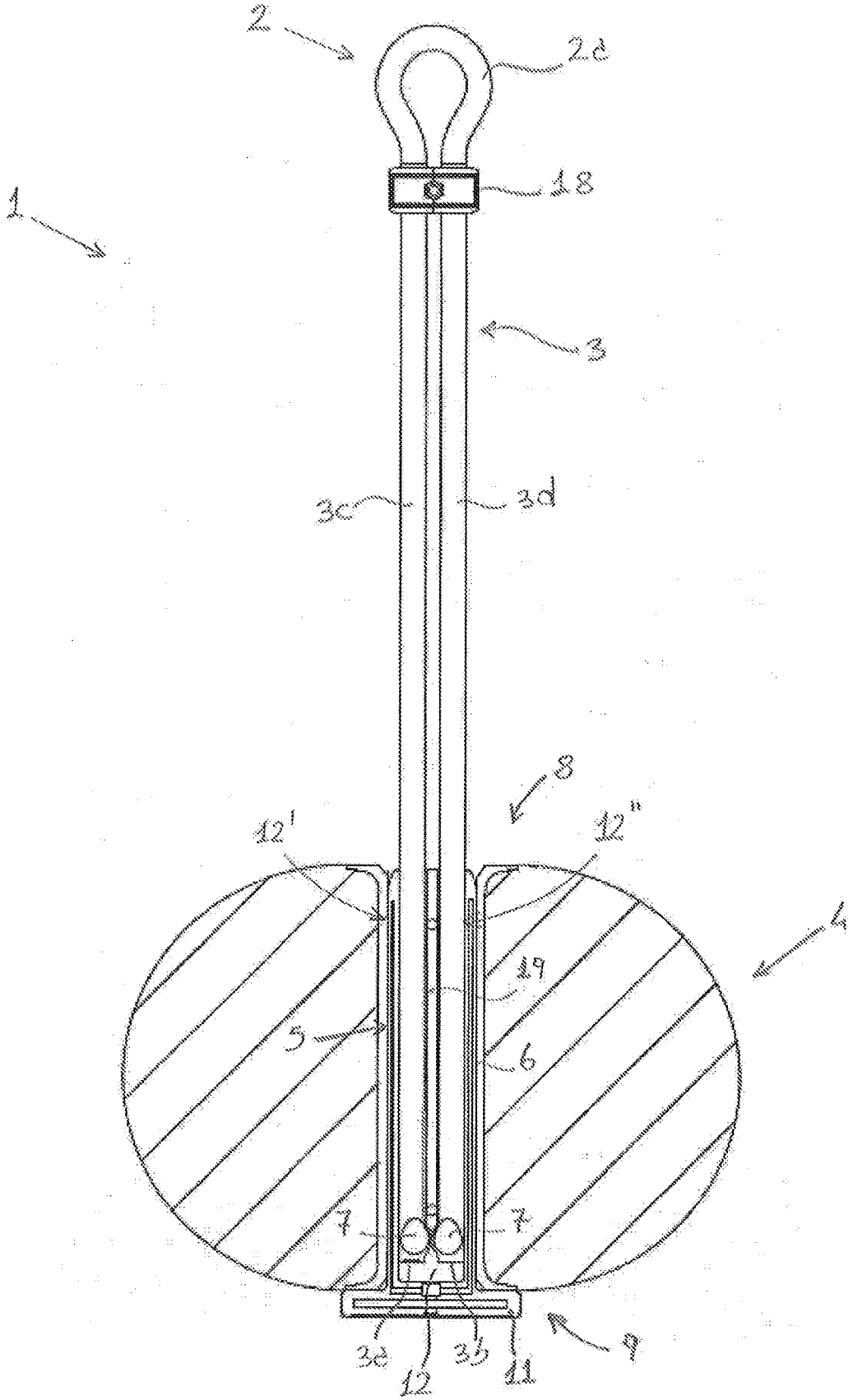
FIG. 5 is a representation of a sectional front view of the device according to a further embodiment of the present invention.
Figure 7:
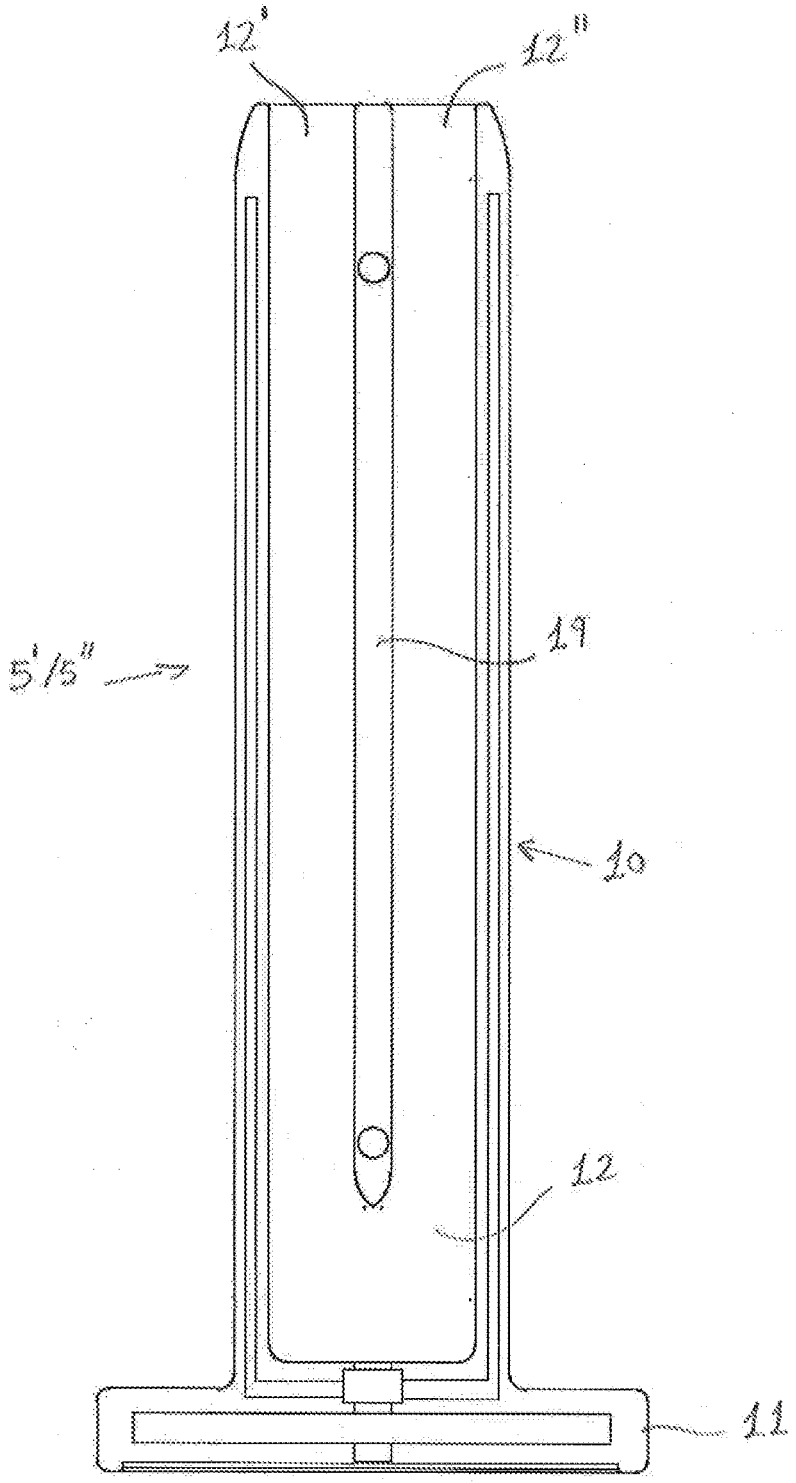
FIG. 7 is a representation of a detail of the device according to the embodiment of the present invention illustrated in FIG. 5.

Another embodiment of the present invention is illustrated in FIG. 5. According to said variant, as shown in FIG. 7, inside the fastening element 5, the cavity 12 has two seats 12', 12", each housing the end part of an element of the suspension means, for example of the two arms of the U shaped formed by joining two mutually parallel elements of the suspension means 3. The two seats are separated by a partition 19 that extends along a direction substantially parallel to the major axis of the hollow piece 10. The partition has the function of narrowing the width of the seat so as to prevent sliding of the blocking elements 7 in the cavity 12.

Figure 6:
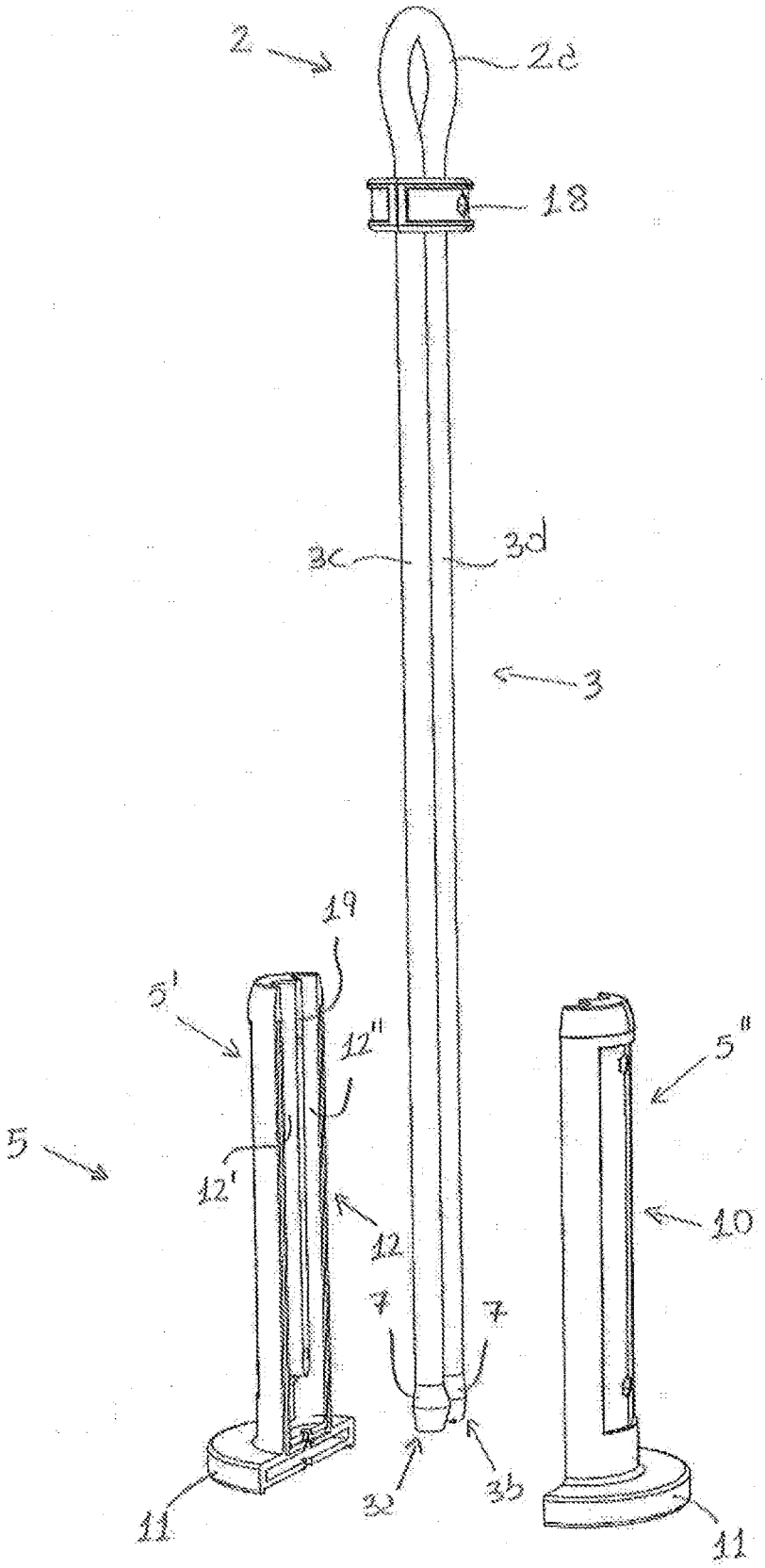
FIG. 6 is an exploded representation of a detail of the device according to the embodiment of the present invention illustrated in FIG. 5.

Preferably, as shown in FIG. 6, the fastening element 5 is separable along the centerline plane into two portions 5', 5" substantially mutually symmetrical.

The advantage of a device in which the suspension means of elastic type consist of at least two parallel elements is that of allowing a higher load, i.e. a mass of greater weight, to be applied with the same elastic resistance of each element of the suspension means. Vice versa, with the same load applied, it would be possible to use elastic suspension means with lower elastic resistance. Besides allowing the use of masses of different weight, the aforesaid variant allows a reduction of the movements of the mass caused by elastic elongation of the elastic means, without changing the aforesaid elastic means.

Figure 3:
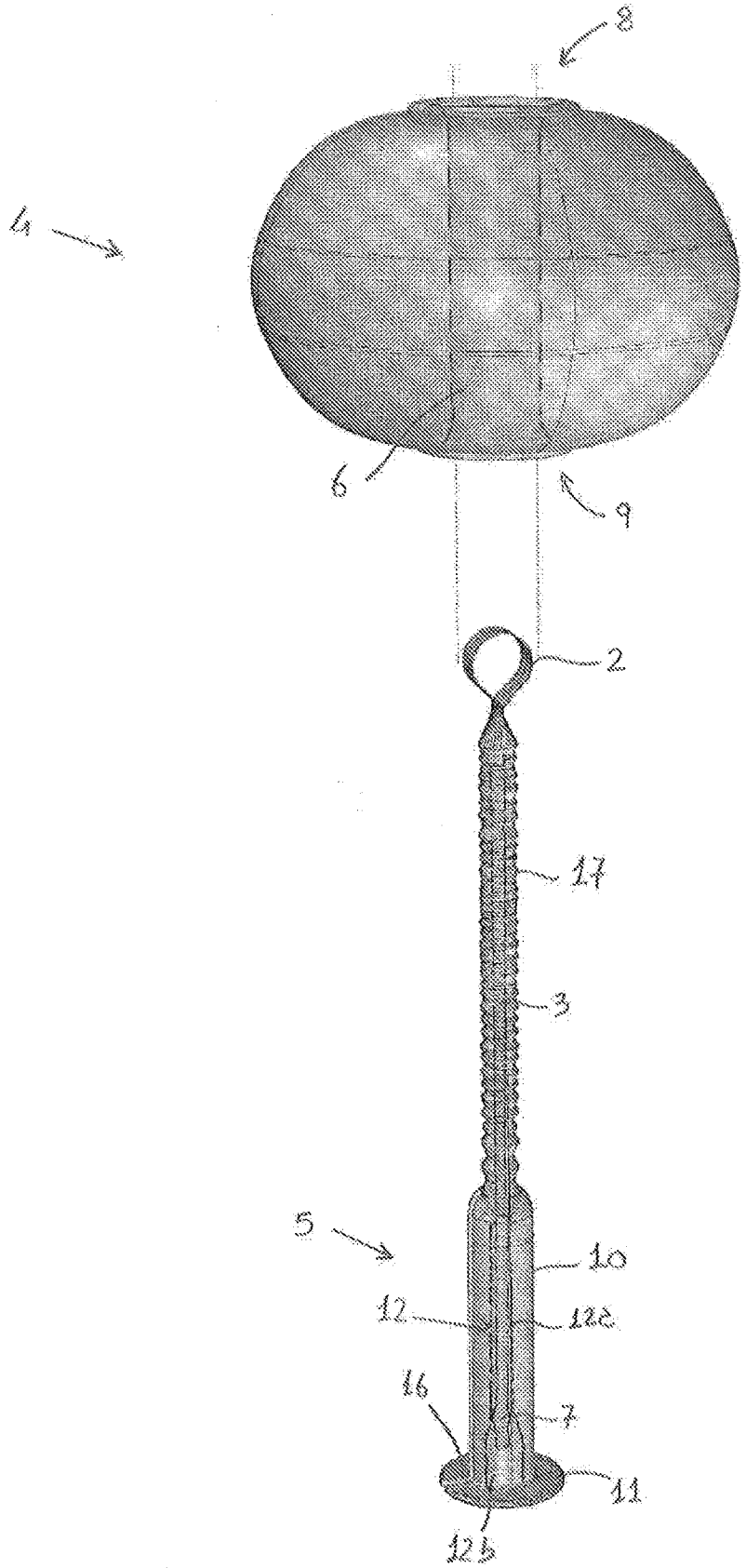
FIG. 3 is a representation of an assembly method of the device according to the embodiment of the present invention illustrated in FIG. 1.

A possible assembly method of the device according to the invention is illustrated in FIG. 3. Once the end part of the suspension means 3 has been inserted, optionally with its grip 2, into the fastening element 5, the grip 2, if present, and the suspension means 2 are inserted into the second opening 9, then into the through hole 6 of the body of the mass 4 and made to exit through the first opening 8. Finally, the mass is made to slide until the second opening 9 of the mass 4 is resting against the abutment element 11 of the fastening element 5.

Another possible assembly method of the device according to the present invention, as mentioned previously and illustrated in FIG. 6, comprises moving the separable parts of the fastening element 5, or of the hollow piece, away from each other, inserting the suspension means 3 into the seats of the through cavity 12, then moving the parts toward each other and closing them again and, finally, inserting the fastening element with the suspension means 3 into the mass 4 through the second opening 9.

As can be noted from the attached FIGS. 1 to 7, in the variants of the device described above, during use, the mass 4 is positioned so that the through hole 6 is substantially vertical. Therefore, in these variants the first opening 8 remains closer to the grip of the exercise device, while the second opposite opening 9 is at a greater distance from said grip.

Figure 8:
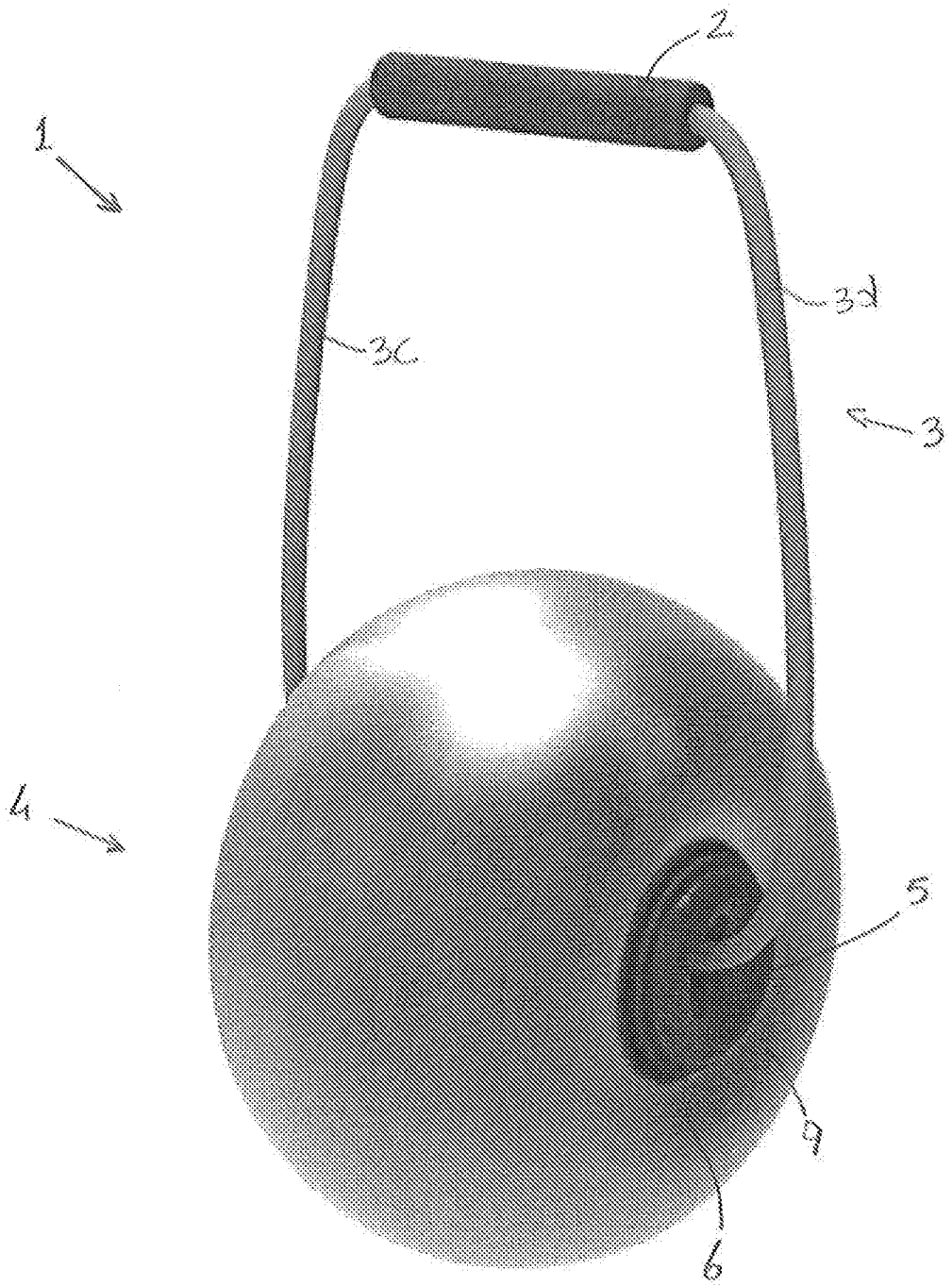
FIG. 8 is a representation of a perspective view of the device according to another embodiment of the present invention.
Figure 9:
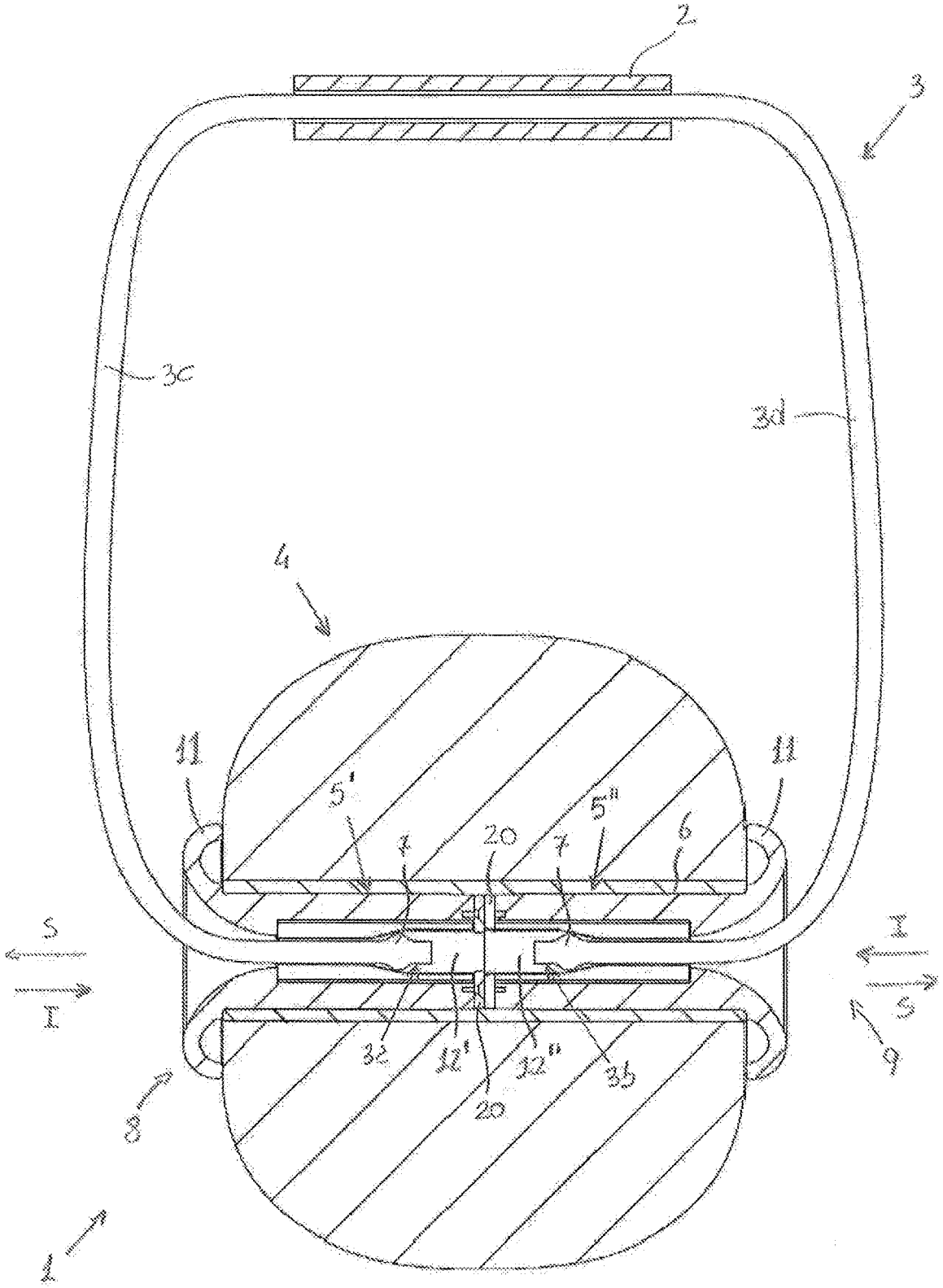
FIG. 9 is a representation of a sectional front view of the device according to the embodiment of the present invention illustrated in FIG. 8.

A further variant of the device according to the invention is shown in FIGS. 8 and 9.

In this variant, the fastening element comprises two parts 5', 5" mutually separable along the major axis, i.e. along a direction S illustrated in FIG. 9. As can be seen in this figure, a portion 12', 12" of the cavity 12 is obtained in each part. An end segment of the ends 3*a*, 3*b* of the suspension means is inserted into each of said portions 12', 12". More precisely, said suspension means 3 comprise a closed element whose ends 3*a*, 3*b* are each inserted into the through hole 6 through a respective opening 8, 9. A grip 2, in the form of sleeve, is inserted onto the suspension means 3.

As can be noted in FIGS. 8 and 9, in this variant of the device, the mass 4 is arranged so that the through hole 6 is substantially horizontal in a position of use of the device. The two branches 3*c*, 3*d* of the suspension means exit from the openings 8 and 9 and converge toward the grip 2.

Blocking of the suspension means 3 in the parts 5', 5" of the fastening element takes place in a manner similar to the variants described previously. In particular, the portions 12', 12" of the cavity 12 have sections of different dimension so as to retain the blocking element 7 at the ends 3*a*, 3*b* of the suspension means 3.

Said ends 3*a*, 3*b* are inserted into the portions of cavity 12', 12" through an inlet facing the outside of the through hole. According to a preferred variant, each part 5', 5" has, at an end facing the outside, an abutment element 11 adapted to abut against the area surrounding said first and second opening of the mass 4, respectively.

Preferably, the parts 5', 5" of the fastening element area equipped with connection means adapted to maintain them joined when they are inserted into the through hole 6. According to a preferred variant, said fastening means comprise magnets 20 arranged at the inner end of the parts 5', 5", opposite the outer end.

To assemble the device according to this variant, the ends 3*a*, 3*b* of the suspension means are inserted into and blocked in the respective cavities 12', 12" of the separable parts 5', 5". Subsequently, the parts 5', 5" are inserted into the through hole 6, along a direction I, each through a respective opening 8, 9 until the inner ends of said parts are in contact or sufficiently close to be maintained close to each other by the magnets 20.

The exercise device according to the present invention can be manufactured in various materials. The material varies depending on the component. For example, the fastening element 5 can be made of materials such as metal, wood and preferably plastic material, while the grip can be made of a material selected from leather, elastic material, or natural, artificial or synthetic fiber, or of one of the aforesaid materials for the fastening element 5.

In particular, the suspension means 3 are well known in the art. There are many embodiments that may, merely to indicate a few examples, consist of a single or multi-material fiber, or two or more mutually woven or parallel fibers with bonds that allow them to slide with respect to one another, etc. The single multi-material fiber can have a structure of the core-covering type, or the like.

Preferably, the suspension means 3 are at least partially covered with a covering sheath 17.

In the embodiment illustrated, the fastening element 5 is produced in one piece, for example by molding of plastic material. However, it can also be produced by assembling the pieces, two or more, of which it is composed.

Similarly, the grip 2 and the suspension means 3 can be produced separately and then assembled, or be produced in one piece.

A further advantage of this exercise device is that it is modular and can be put together at the time of use. Therefore, this device can be assembled with the most suitable components, for example with reference to the dimensions and weight of the mass, depending on the person who will be using it.

The invention has been described purely for illustrative and non-limiting purposes, according to some preferred embodiments. Therefore, a person skilled in the art can make modifications or variations, all of which are considered as falling within the scope of protection of the present invention.

The invention claimed is:

1. An exercise device (1) comprising:

flexible suspension means (3) elongated, the flexible suspension means (3) being thin in shape and made of an elastic material;

a mass (4) having a body; and a fastening element (5) that can be blocked on the mass (4), the mass (4) has a through hole (6) through which said flexible suspension means (3) pass, said through hole (6) being provided with a first opening (8) and a second opening (9), wherein the fastening element (5) comprises a hollow piece (10) that can be inserted in said through hole (6) and that is provided therein with at least one cavity (12) in which at least one portion of a part of the flexible suspension means (3) inserted into the through hole (6) is housed, wherein the fastening element (5) is separable into two parts (5', 5") with respect to a plane parallel to a major axis of the fastening element (5), and wherein the flexible suspension means (3) comprises a single element bent and having a first end (3*a*) and a second end (3*b*), each of the first and second ends (3*a*, 3*b*) being fastened in the at least one cavity (12) of the fastening element (5).

2. The exercise device (1) according to claim 1, wherein at least an end of the hollow piece is provided with an abutment element (11) that abuts against an area surrounding at least one of said first and second openings (8, 9) of the body of the mass (4).

3. The exercise device (1) according to claim 1, wherein the flexible suspension means (3) have, at a level of or close to at least one of the first and second ends (3*a*, 3*b*), a blocking element (7) adapted to constrain the flexible suspension means (3) to the fastening element (5).

4. The exercise device (1) according to claim 3, wherein the flexible suspension means (3), at least close to or at a level of the first end (3*a*), are hollow so as to house the blocking element (7).

5. The exercise device (1) according to claim 4, wherein the blocking element (7) is a ball.

6. The exercise device (1) according to claim 1, wherein the flexible suspension means are provided with a slider (18) that delimits a portion of the suspension means that acts as a grip.

7. The exercise device (1) according to claim 1, wherein the flexible suspension means (3) are bent in a U-shape and wherein the at least one cavity (12) of the fastening element (5) has at least two seats (12', 12"), each of the at least two seats housing one of the first and second ends (3*a*, 3*b*) of the flexible suspension means (3) bent in a U-shape, and separated by a dividing wall (19) that extends along a direction substantially parallel to ire a major axis of the fastening element (5).

8. The exercise device (1) according to claim 7, wherein the flexible suspension means (3) have, at a level of or close to at least one of the first and second ends (3*a*, 3*b*), a blocking element (7) adapted to constrain the suspension means (3) to the fastening element (5), and in which the dividing wall creates at least one narrowing in the at least two seats (12', 12") to prevent sliding of the blocking element (7).

9. The exercise device (1) according to claim 1, wherein the mass (4) is a spheroid body.

* * * * *